United States Patent [19]

Franks

[11] Patent Number: 4,475,695

[45] Date of Patent: Oct. 9, 1984

[54] POWER ASSIST UNCOILER

[75] Inventor: Lawrence A. Franks, Sturgis, Mich.

[73] Assignee: Burr Oak Tool & Gauge Company, Sturgis, Mich.

[21] Appl. No.: 449,092

[22] Filed: Dec. 13, 1982

[51] Int. Cl.[3] ..... B65H 51/24; B65H 51/28; F16H 25/18

[52] U.S. Cl. ..... 242/54 R; 242/78.6; 74/110; 74/531

[58] Field of Search ..... 242/78.6, 75, 75.44, 242/75.43, 156, 156.2, 54 R; 74/128, 150, 153, 813, 80, 110, 531

[56] References Cited

U.S. PATENT DOCUMENTS

| | | | |
|---|---|---|---|
| 1,182,679 | 3/1916 | Hatton | 242/156.2 |
| 2,905,406 | 9/1959 | Falck-Pedersen | 242/75 |
| 3,081,957 | 3/1963 | Van De Bilt | 242/54 |
| 3,227,390 | 1/1966 | Wendelken | 242/75 |
| 3,436,031 | 4/1969 | Winders | 242/54 |
| 3,446,452 | 5/1969 | Tetens | 242/75 |
| 3,568,488 | 3/1971 | Franks | 72/68 |
| 3,688,999 | 9/1972 | Plattner et al. | 242/75 |
| 3,787,001 | 1/1974 | Henry | 242/75 |
| 3,921,928 | 11/1975 | Henry | 242/75 |
| 4,050,355 | 9/1977 | Niskanen | 74/817 |
| 4,085,608 | 4/1978 | Franks et al. | 72/297 |

OTHER PUBLICATIONS

"Hairpin Bends from Coiled Tubing", Burr Oak Tool & Gauge Company.

"Double Vertical Bend Hairpin Bender (Hairpin Bends from 'Jumbo' Coils"), Burr Oak Tool & Gauge Company.

*Primary Examiner*—Stanley N. Gilreath

*Assistant Examiner*—Leo J. Peters

*Attorney, Agent, or Firm*—Flynn, Thiel, Boutell & Tanis

[57] ABSTRACT

A forming apparatus for cutting and forming tubing, which apparatus has a tubing-advancing drive unit associated therewith for engaging the tubing and intermittently feeding it into the apparatus, and a coil stand positioned adjacent the apparatus for permitting elongate flexible tubing to be intermittently supplied thereto. The coil stand includes a frame mounting thereon a shaft, and a reel supported on the shaft and being rotatable about the axis thereof. The reel includes a pair of end flanges which confine a coil of tubing therebetween, which tubing as unwound from the reel is led therefrom into the forming apparatus wherein it is engaged by the drive unit thereof. A drive means is engageable with the reel to initiate rotation thereof in an unwinding direction to permit feeding of tubing from the reel to the apparatus, which drive means is automatically disengaged from the reel after a selected interval to permit continued free rotation of the reel in the unwinding direction.

13 Claims, 8 Drawing Figures

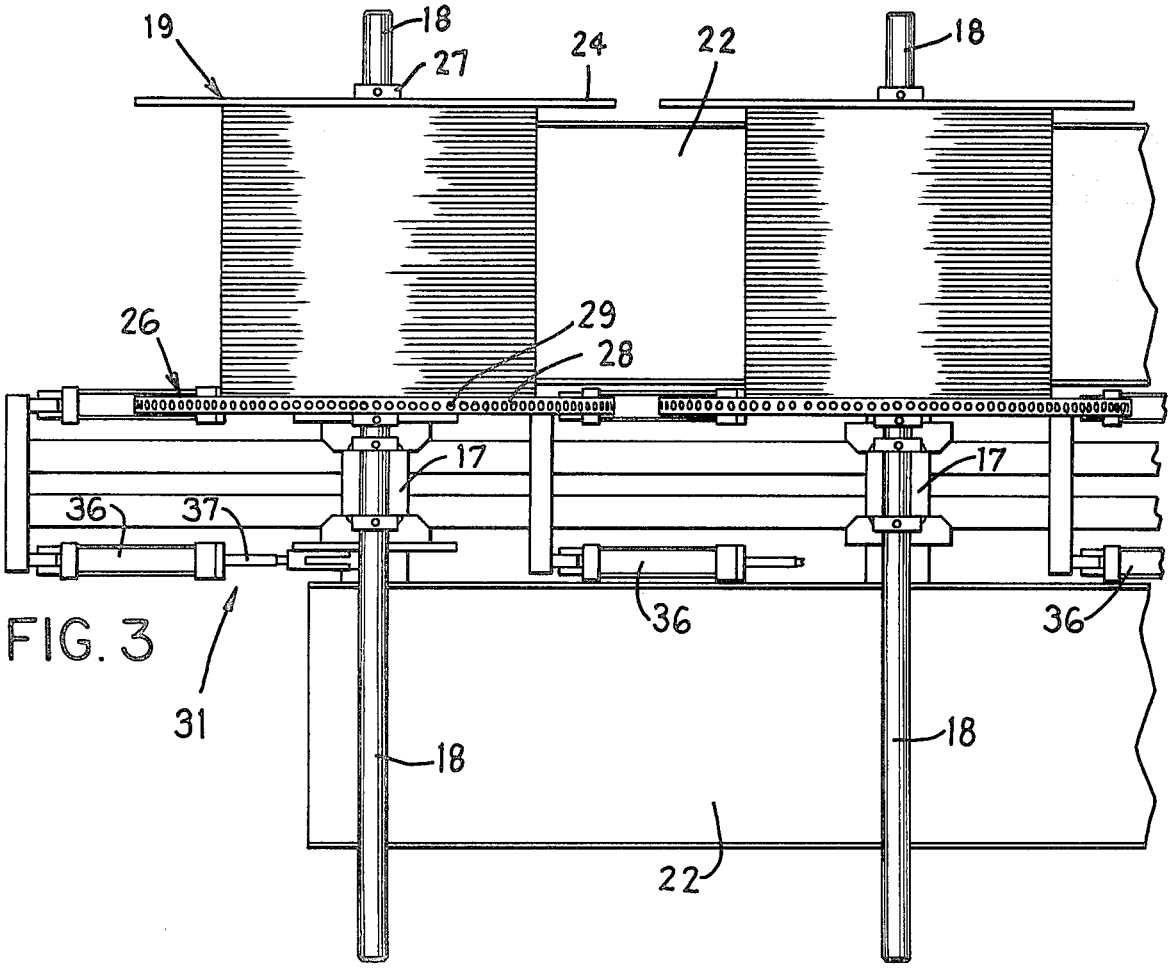
FIG. 3
FIG. 2
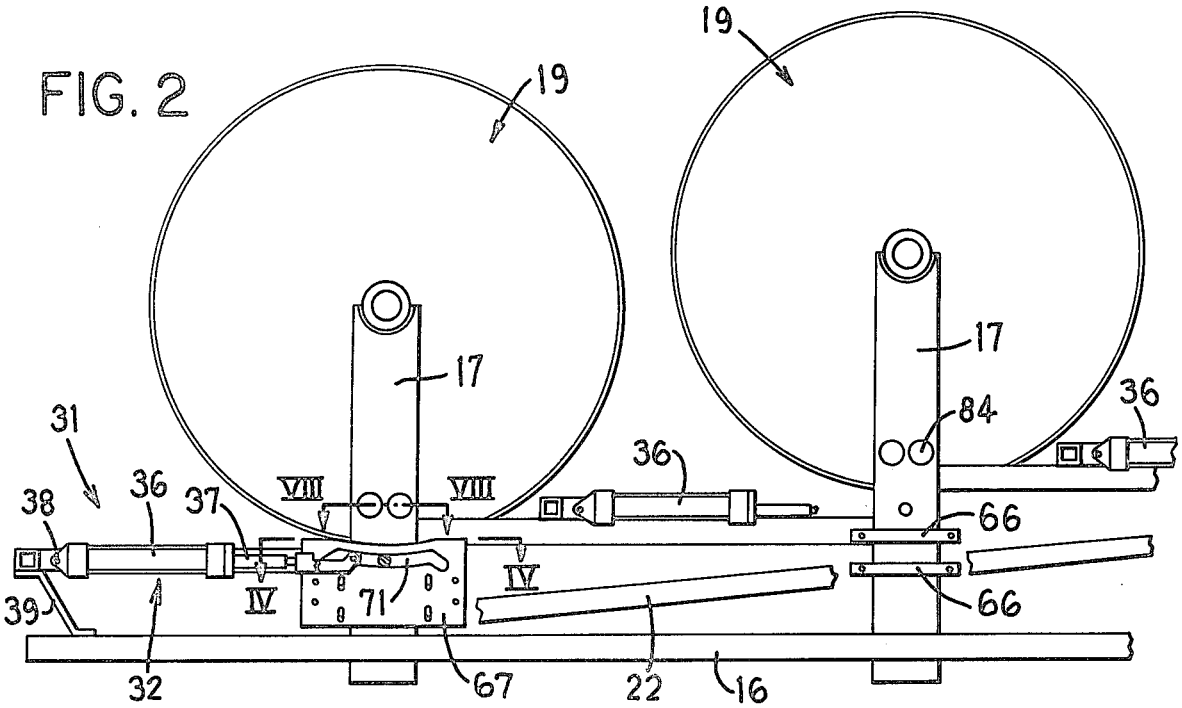

POWER ASSIST UNCOILER

FIELD OF THE INVENTION

This invention relates to a coil stand for supporting a plurality of coils of tubing and, in particular, to an improved coil stand having driving devices for assisting in initiating rotation of the coils when tubing is to be fed therefrom to a forming apparatus such as a hairpin bender.

BACKGROUND OF THE INVENTION

Tube-type heat exchangers are extensively utilized, and these heat exchangers normally employ a large number of tubes connected in series and disposed in adjacent parallel relationships. The adjacent tubes are connected by end fittings which are commonly referred to as hairpins. To facilitate the forming of hairpins and similar such fittings, various machines have been developed which permit tubular stock to be withdrawn from a supply coil, following which the free end of the tubular stock is formed into the desired shape and is severed from the stock which remains connected to the coil. The known apparatus capable of forming such hairpins have typically permitted the simultaneous forming of several identical fittings during each forming operation, and hence have required the use of a coil stand disposed adjacent the input end of the apparatus, which coil stand typically supports several identical coils of tubing thereon. The coils are individually supported for rotation substantially about horizontal axes, whereby tubing is unwound from all of the coils and fed into the forming apparatus during each cycle to permit the simultaneous formation of a plurality of identical hairpins or like fittings. The forming apparatus typically has a drive device associated therewith which intermittently grips the plurality of tubes to feed a selected length thereof into and through the apparatus. The coils are thus intermittently rotatably moved in a steplike manner to intermittently feed tubing to the apparatus. With this arrangement, however, the coils have necessarily been limited with respect to their maximum size in order to permit the coils to be intermittently rotated and stopped in a steplike manner consistent with the driving and production capability of the forming apparatus. This has hence limited the capability of the apparatus, particularly with respect to the usable size of coils, since the excessive inertia of large coils has prevented them from being successfully utilized due to the difficulty of both initiating and stopping rotation. Reference is made to earlier U.S. Pat. Nos. 3 568 488 and 4 085 608, as owned by the assignee of this application, the disclosures of which are incorporated herein by reference. These earlier patents disclose known apparatus for forming hairpins, which apparatus utilized coil stands for supporting a plurality of tubing coils which individually feed tubing to the apparatus.

Since earlier forming apparatus have normally relied upon friction belts or releasable clamps for intermittently engaging and advancing the tubing, this has hence limited the capacity and capability of the apparatus. For example, when the tubing coil becomes large, it is difficult for the known apparatus to properly initiate rotation of the coil to effect unwinding of the tubing. In some instances, there has been insufficient slippage so that excessive strain is imposed on the tubing. In other instances, this has resulted in excessive slippage between the tubing and the driving device so that improper feeding of the tubing results. Alternately, the operational or production rate of the apparatus has been reduced to a magnitude consistent with the capability of the apparatus to intermittently withdraw the tubing from the coil. At the same time, difficulties have been encountered with the prior apparatus in terms of stopping the coil after the desired amount of tubing has been unwound since, particularly when the coil is large, the inertia of the rotating coil makes stoppage of same difficult so that excessive unwinding is commonly encountered.

Accordingly, it is an object of the present invention to provide an improved stand for supporting a plurality of tubing coils, which stand has power-assist units for drivingly engaging the coil spools to at least assist the initial start-up rotation thereof when tubing is to be unwound therefrom. This improved stand preferably has a braking system associated therewith for engaging the coil spools to stop same so that proper unwinding and feeding of tubing from the coil to the forming apparatus can be accurately and precisely controlled in accordance with the desired mode of operation and production rate of the forming apparatus. The improved coil stand of this invention hence overcomes many of the disadvantages associated with the known structures of this type.

Another object of the invention is to provide an improved coil stand, as aforesaid, which permits the utilization of coils of substantially increased size, while at the same time permitting efficient starting and stopping of the coils so as to permit intermittent unwinding and feeding of tubing to a forming apparatus, whereby the stepwise rotation of the coil can be properly synchronized with the operational cycle of the forming apparatus in such manner as to permit the forming apparatus to operate in an efficient and highly productive manner. Since this improved stand permits the use of substantially larger coils, the forming apparatus can be maintained in substantially continuous operation for greatly increased periods of time, whereby costly and time consuming shut-downs caused by the necessity of having to replace empty coil spools can hence be greatly minimized.

In the present invention, there is provided a stand or frame having a plurality of upright supports or posts each provided with a substantially horizontal axle, and each of these axles is adapted to rotatably support one or more spools each containing a coil of tubing therearound. The stand is positionally related to the input end of a forming apparatus, such as the apparatus disclosed in U.S. Pat. No. 3 568 488, so that a plurality of side-by-side tubes can be simultaneously fed into the apparatus in an intermittent steplike manner to permit a selected length of tubing to be appropriately formed and severed from the remaining tubing. An intermittent reciprocal drive device is mounted on the stand for cooperative engagement with a respective spool, which drive device in the preferred embodiment includes a reciprocal driving element having a driving pin or lug which is engageable with one of a series of openings or recesses formed in an end flange on the respective spool. When the forming apparatus signals for the advancement of the tubing, the drive device is energized so that the drive lug engages the spool and provides a power-assist to initiate the rotation of the spool in an unwinding direction, following which the drive lug automatically disengages the spool so that it can continue to rotate and hence unwind the desired length of tubing therefrom. When the desired length of tubing has been fed into the forming apparatus, as determined by the separate driving means associated therewith, the forming apparatus then transmits a stop signal to the stand for energizing a brake which engages the spool so as to stop rotation thereof. At a selected time, the reciprocal drive device is returned to its initial position, and during this return the drive lug again momentarily engages and reversely rotates the spool a selected angular extent, which limited reverse rotation is sufficient to eliminate or minimize the slack in the tubing which extends from the spool to the forming apparatus. Successive operational cycles can be automatically and efficiently performed, with each operational cycle involving the same series of engagements and movements.

Other objects and purposes of the invention will be apparent to persons familiar with apparatus of this general type upon reading the following specification and inspecting the accompanying drawings.

BRIEF DESCRIPTION OF THE DRAWINGS

In the drawings:

FIG. 2 is a fragmentary, side elevational view illustrating the drive unit associated with each spool for initiating rotation thereof, parts of the housing or closure structure for the drive unit being removed for purposes of clarity.

FIG. 3 is a plan view which corresponds to FIG. 2 and illustrates the spools associated with the rearward ends of the axles, the spools on the forward ends of the axles being removed for clarity of illustration.

Figure 1:
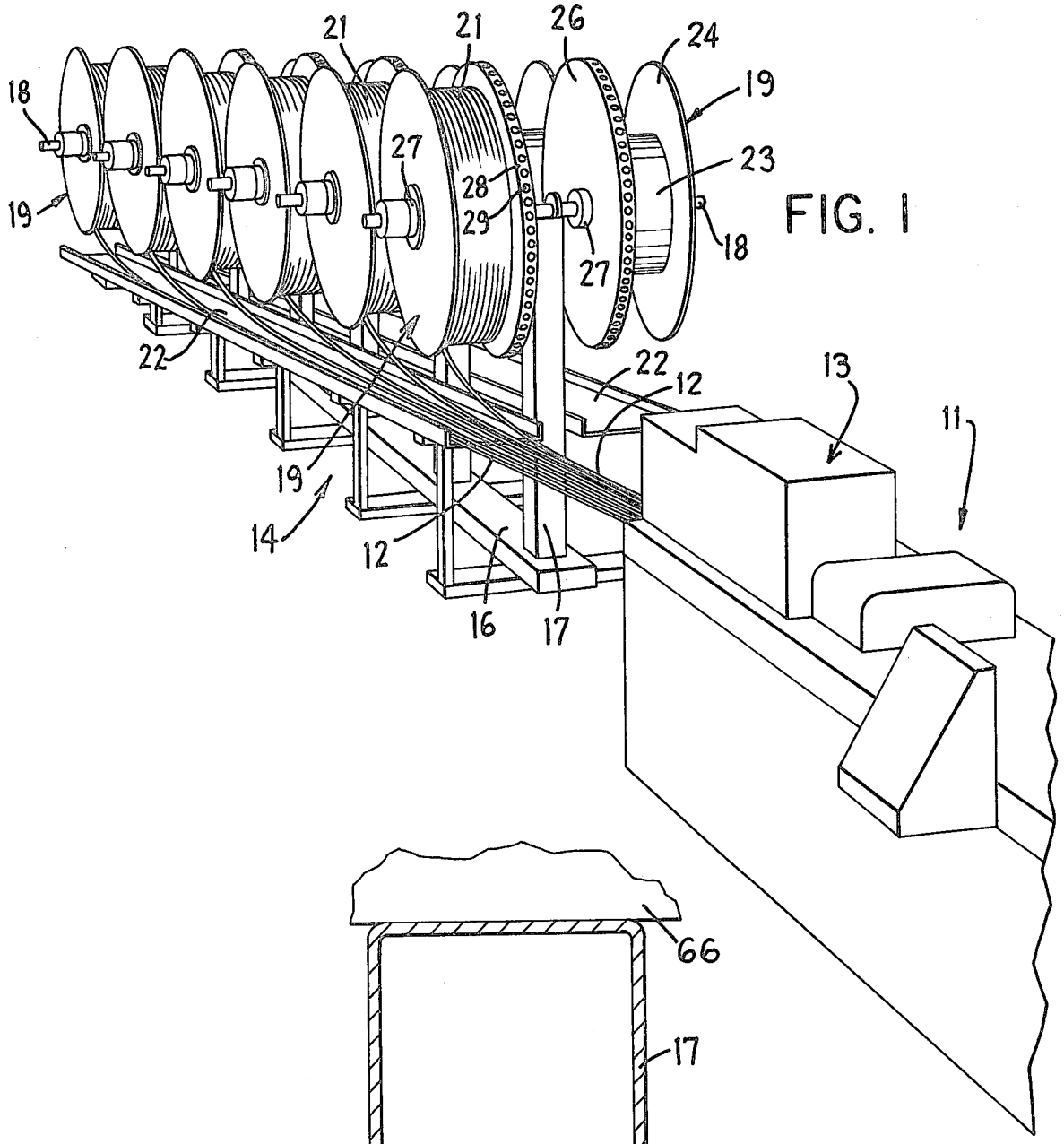
FIG. 1 is a perspective view of a stand supporting thereon a plurality of spools each having a tubing coil therearound, with the tubing being withdrawn from the individual spools and supplied to a conventional forming apparatus, the latter being only diagrammatically illustrated.
Figure 4:
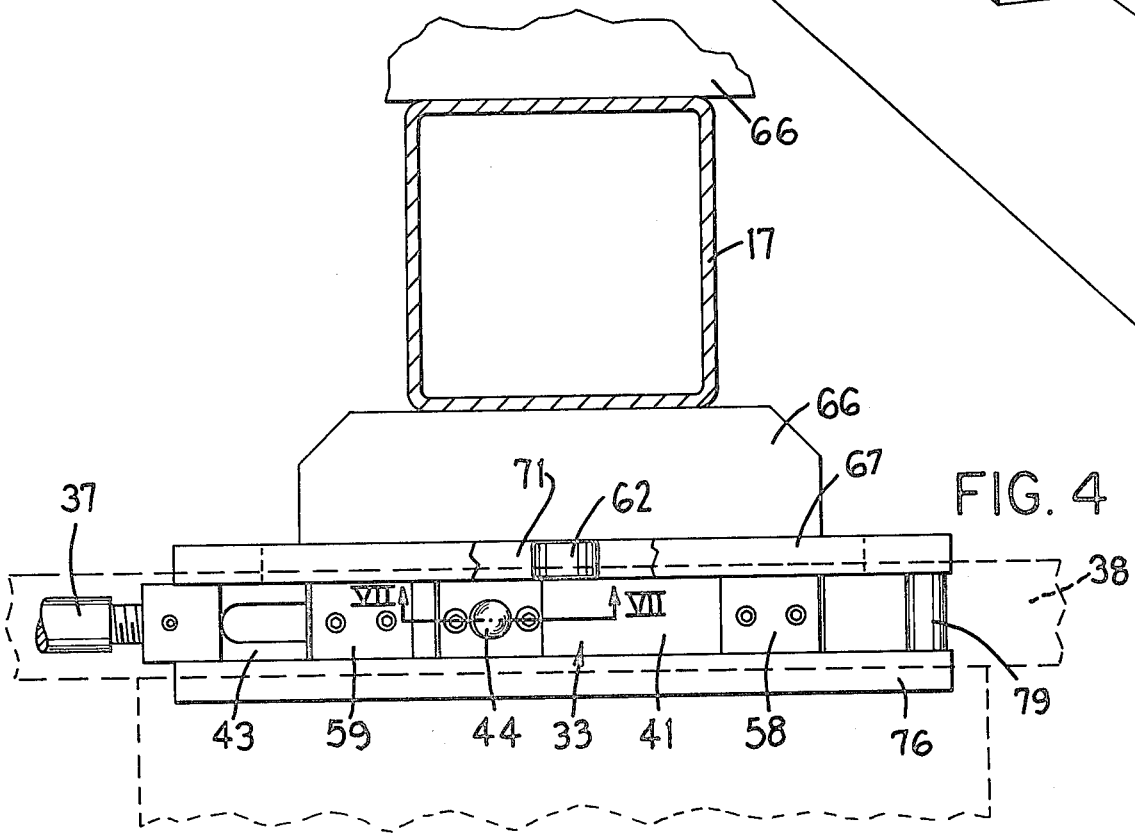
FIG. 4 is an enlarged, fragmentary, sectional view taken substantially along line IV—IV in FIG. 2.

Certain terminology will be used in the following description for convenience in reference only, and will not be limiting. For example, the words "upwardly", "downwardly", "rightwardly" and "leftwardly" will refer to directions in the drawings to which reference is made. The word "forwardly" will refer to the normal feeding direction of the tubing from the coil to the forming apparatus, which direction is rightwardly in FIGS. 1–3. The words "inwardly" and "outwardly" will refer to directions toward and away from, respectively, the geometric center of the apparatus and designated parts thereof. Said terminology will include the words specifically mentioned, derivatives thereof, and words of similar import.

DETAILED DESCRIPTION

FIG. 1 illustrates a system for withdrawing tubing from a coil and then severing and forming a selected length of tubing into an object such as a hairpin or the like. This system specifically includes a conventional forming apparatus 11 which may be of many different types, one example of which is illustrated in U.S. Pat. No. 3 568 488. This forming apparatus 11 permits a plurality of elongated tubes 12 to be supplied thereto in side-by-side relationship, which apparatus 11 effects the cutting or separation of a selected length of tubing from the leading end thereof and the forming thereof, such as the bending of the tubing into a hairpin. The forming apparatus 11 typically has a drive unit 13, such as opposed endless drive belts, which is selectively energized for engaging and advancing the tubes 12 into and through the apparatus 11 in an intermittent or steplike manner in accordance with the operational cycle of the apparatus.

The plurality of tubes 12 are typically supplied to the apparatus 11 from a coil stand 14 which, as illustrated by FIG. 1, typically includes a base or frame 16 having a plurality of rigid support posts 17 projecting upwardly therefrom, the frame 16 being elongated and substantially aligned with the input end of the apparatus so that the posts 17 are hence disposed in spaced relationship along the elongated direction of the frame. Each post 17 mounts a support shaft or axle 18 adjacent the upper end thereof, which axle 18 projects horizontally outwardly from opposite sides of the post 17 in a cantilevered fashion. Each projecting end of shaft 18 is adapted to rotatably support thereon a rather large reel or spool 19 which supports a coil 21 of tubing 12 therearound. The posts 17 are generally of diminishing heights as they project from the forward to the rearward end of the stand, whereby the support shafts 18 are hence at a progressively decreasing elevation. This results in the plurality of coils 21 also being of progressively decreasing elevation as they are positioned from the forward to the rearward end of the stand so as to prevent or minimize possible interference between the tubing as withdrawn from the rows of reels located on opposite sides of the aligned posts. A shallow, upwardly opening, channel-like guide 22 is preferably fixed to the frame and extends therealong beneath the row of reels, which guide 22 is also inclined upwardly in its forward direction so as to be substantially parallel with the plane defined by the axles 18. The guide 22 hence confines, guides and slidably supports the plurality of tubes 12 as they are withdrawn from the various coils 21 and fed into the apparatus 11. The guide 22 can be positioned above the coils 21 if it is desired to take off the tubing from the upper portions of the coils.

The coil stand 14 possessing the structural and functional relationships described above is already known for use in conjunction with a forming apparatus 11.

The structure of the reel 19 is, for the most part conventional in that it includes a sleevelike core 23 which is fixed to and extends between a pair of parallel end flanges 24 and 26, with the reel 19 being suitably rotatably supported on shaft 18 by conventional antifriction bearings 27. According to the present invention, however, one of the reel end flanges, here the inner end flange 26, is provided with a ringlike rim plate 28 having a plurality of driving recesses or openings 29 formed therein, which openings 29 are formed in the rim plate at close and uniformly spaced intervals around the complete cylindrical periphery thereof. If desired, the flange 26 including the plate 28 and recesses 29 can be provided as the outer reel end flange.

A drive unit 31 is associated with each of the reels 19 to assist in initiating rotation thereof when withdrawal or unwinding of tubing therefrom is desired. This drive unit 31 includes a fluid pressure cylinder 32 connected to a reciprocal drive 33 which is suitably slidably guided by a support structure 34 so that the reciprocal drive 33 will engage and disengage the driving recesses or openings 29 on the reel during both the forward (that is, the rightward) and the rearward (that is, the leftward) stroke of the drive unit.

The fluid pressure cylinder 32 is conventional, and preferably comprises a double-acting cylinder having a standard housing 36 confining therein a slidable piston which is secured to a piston rod 37 which slidably projects outwardly from one end of the housing 36. The other end of housing 36 is preferably connected, as by a horizontal hinge pin 38, to a stationary frame member 39.

Figure 7:
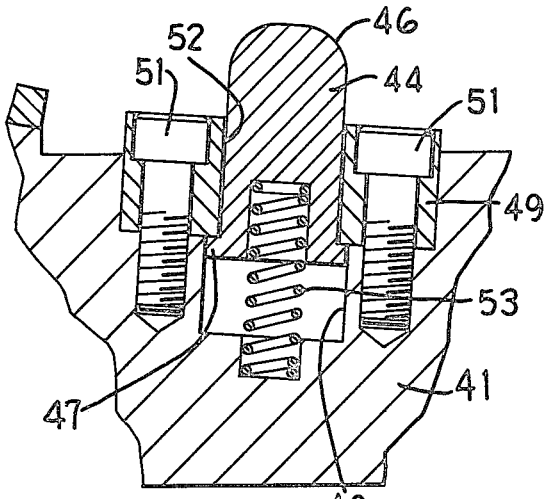
FIG. 7 is an enlarged, fragmentary, sectional view taken substantially along line VII—VII in FIG. 4.

The projecting end of piston rod 37 is connected to the reciprocal drive 33, which drive 33 includes a plate-like carrier 41 which is hingedly connected by a horizontal hinge pin 42 to the forward end of a clevis 43, which clevis at its rearward end is fixedly, that is threadably, connected to the free end of the piston rod 37. The clevis 43 is of a bifurcated or forklike structure, and the rearward end of plate 41 has the opposite sides thereof provided with recesses 45 for accommodating therein the legs of the clevis 43 so that the clevis 43 hence has a width which substantially corresponds to that of the carrier 41. The carrier 41 mounts thereon a driving lug or projection 44 which projects upwardly from the upper surface of the carrier 41. This driving lug 44, as illustrated by FIG. 7, has a rounded outer end 46 and, at its lower end, a radially outwardly projecting flange 47 which slidably guides the lug 44 within a substantially cylindrical opening or bore 48 as formed in carrier 41 and opening upwardly through the upper surface thereof. The lug 44 is retained within opening 48 by a retainer plate 49 which is secured to the carrier 41 by screws 51. The retainer plate 49 has an opening 52 therethrough which is smaller than the opening 48, and the main portion of driving lug 44 is sized so as to slidably project through the opening 52. A conventional compression spring 53 is seated within the opening 48 and bears against the lower end of lug 44 for normally urging same into an outermost projecting position substantially as illustrated in FIG. 7, in which position the lower end flange 47 abuts the underside of the retainer plate 49. In this normal outwardly biased position of the driving lug 44, the lug can be slid downwardly into the bore 48 until the free end of the lug is substantially flush with the upper surface of the retainer plate 49. The spring 53 is preferably confined within bores formed in the lug and in the carrier 41 so as to permit the lug to be effectively fully retracted into the opening 48.

Figure 5:
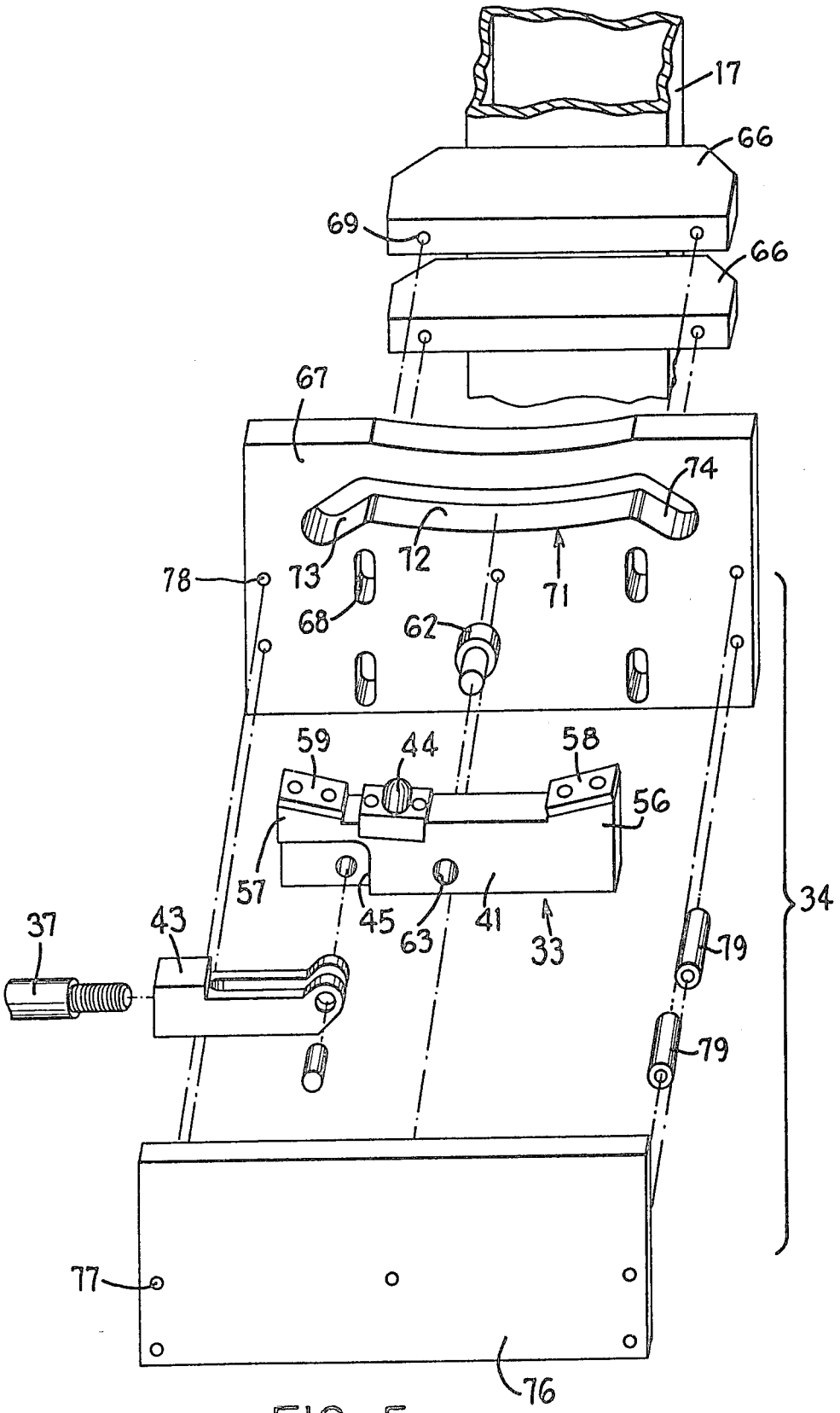
FIG. 5 is an enlarged, fragmentary, perspective view illustrating, in exploded manner, the reciprocal drive and the associated cam and support structure.
Figure 6:
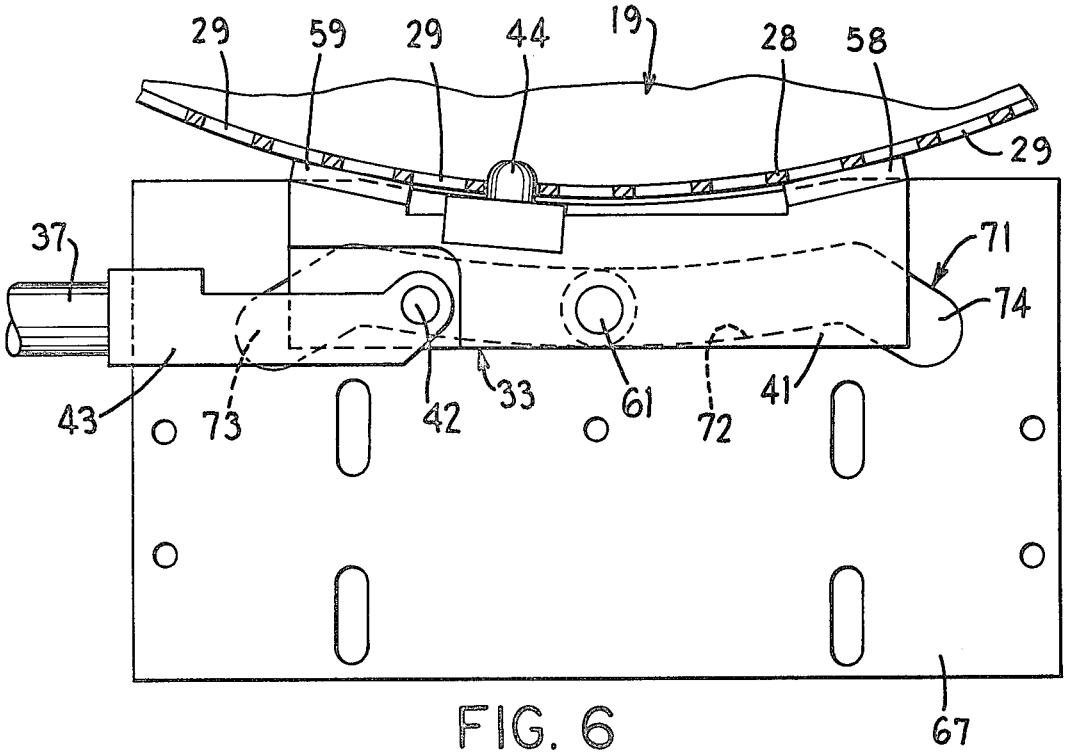
FIG. 6 is an enlarged, fragmentary, sectional view illustrating the engaged and driving relationship between the reciprocal drive member and the spool.

The carrier 41, as illustrated by FIG. 5, has end portions 56 and 57 which project slightly upwardly above the center portion of the carrier, whereby the carrier has a shallow, upwardly opening, channel or U-shaped configuration. The upper surfaces of these end portions 56 and 57 have suitable wear plates 58 and 59, respectively, fixedly but replaceably secured thereto. These wear plates 58 and 59 define upper planar surfaces which, as they project inwardly toward one another, are slightly inclined downwardly with respect to one another. The relationship of these surfaces or wear plates 58 and 59 is such that they are individually disposed substantially tangential to the reel rim 28 when the reciprocal drive 33 is moved into engagement therewith.

Carrier 41 also mounts thereon a horizontal hinge pin 61 which is secured within the opening 63 and projects outwardly from one side of the carrier 41 so as to mount thereon a conventional cam roller 62. This cam roller, the purpose of which will be explained hereinafter, has the axis thereof disposed in parallel but spaced relationship from the hinge axis 42 which defines the connecting hinge between the carrier 41 and the reciprocal pressure cylinder.

Considering now the support structure 34 for the reciprocal drive 33, this includes a substantially vertical cam plate 67 which is secured to a pair of spaced brackets 66 as secured to one side of the respective upright post 17. Cam plate 67 has a series of vertically elongated slots 68 which align with openings 69 formed in the brackets 66 whereby appropriate screws or threaded fasteners extend therebetween for fixedly mounting the cam plate 67 on the brackets 66, while permitting at least limited vertical adjustment as to the height of the cam plate 67.

Cam plate 67 has an elongated cam slot 71 formed therein, which cam slot includes an elongated center portion 72 extending between shorter rear and front portions 73 and 74, respectively. The center cam portion 72, when viewed along the longitudinal center line thereof, is of a shallow upwardly curved configuration, and in fact the configuration of this elongated center portion 72 effectively defines the arc of a circle having a radius approximately corresponding to the radial spacing between the center slot 72 and the axis of the support axle 18.

The rear cam slot portion 73 effectively forms an extension of the center slot portion 72 but slopes downwardly as it continues to project rearwardly, whereby this rear cam slot portion 73 hence moves radially away from the axis of shaft 18 as the slot portion 73 extends further rearwardly. The front cam slot portion 74 is substantially identical to the rear slot portion 73 except that it projects in the forward direction as it slopes downwardly, and hence radially outwardly, away from the axis of the shaft 18. The cam slot 71 is sized, in terms of its vertical height, so as to closely but movably confine the cam roller 62 therein.

A vertical cover plate 76 is positioned so as to overlap the cam plate 67 and hence slidably confine the reciprocal drive 33 therebetween. This cover plate 76 has holes 77 therein which align with similar holes 78 formed in the cam plate, whereby suitable threaded fasteners such as screws or bolts extend therebetween for fixedly connecting the plates 67 and 76 together. Appropriate spacers 79 are fixedly held between the plates 67 and 76 so as to maintain them spaced apart by a distance which slightly exceeds the width of the carrier plate 41 so that the latter is hence closely but slidably confined between the plates 67 and 76.

Each of the reels 19 also has a brake unit 81 (FIG. 8) associated therewith. This brake unit 81 includes a conventional fluid pressure cylinder 82, such as a double-acting pneumatic cylinder, the housing of which is mounted within the post 17 in close proximity to the respective reel. The cylinder 82 is mounted such that the reciprocal piston rod 83 thereof projects horizontally toward the respective reel, and a conventional friction brake pad 84 is secured to the end of piston rod 83 so that the pad 84 can hence be moved into frictional braking engagement with the adjacent axial end surface 86 of the reel flange 26.

Figure 8:
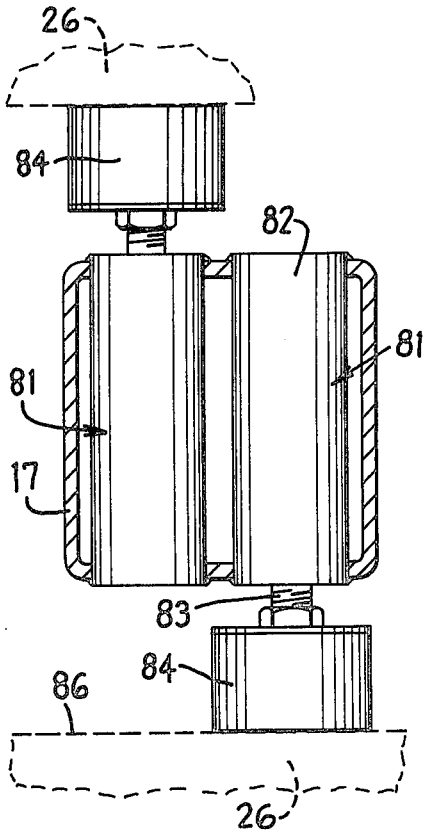
FIG. 8 is an enlarged, fragmentary, sectional view taken substantially along line VIII—VIII in FIG. 2.

As illustrated by FIGS. 2 and 8, a pair of substantially identical brake units 81 are mounted in side-by-side relationship within each post, whereby the brake units project outwardly toward opposite sides of the post so as to hence engage the pair of reels 19 which are mounted coaxially on opposite ends of the shaft 18. The brake units are preferably positioned on the post such that the friction brake shoes will engage the reel flange 26 in the vicinity of the radially outer extent thereof so as to maximize the frictional braking torque developed.

OPERATION

The operation will be briefly described to insure a complete understanding of the coil stand 14, and its relationship with the forming apparatus 11. For convenience in explanation and understanding, this description will relate solely to the operation of a single reel, although it will be appreciated that all of the reels are normally operated simultaneously since all of the brake cylinders 82 and drive cylinders 32 are respectively connected to and simultaneously activated from common sources of pressure fluid.

Assuming that the system has been set up so that the tubing from the various reels is fed into the apparatus 11 as illustrated by FIG. 1, the apparatus can then cyclically perform the desired forming operations. When in this position for initiating a cycle of operation, the friction brake unit 81 is normally engaged with its reel 19 to hold it stationary, and the respective drive unit 31 is in its rearward disengaged position. When in this rearward disengaged position, the reciprocal support 33 is disposed so that the cam roller 62 thereof is positioned within the lower rearward end of rear cam slot 73, whereupon the carrier 41 is positioned downwardly away from the reel flange 26 so that driving lug 44 is not engaged with the flange rim 28. When the apparatus 11 is energized to initiate a forming cycle, the tube drive unit 13 thereof is energized so as to engage and forwardly advance the tubing 12 into the apparatus 11. Simultaneously therewith, the apparatus 11 also emits appropriate signals so that the respective brake unit 81 is released, and the respective drive unit 32 is energized. That is, the pressure cylinder 36 is pressurized so that piston rod 37 is extended forwardly, whereby the reciprocal drive 33 is hence moved forwardly whereby the cam roller 62 moves upwardly along the rear cam slot 73 into the elongated center cam slot 72. This upward and forward movement of the carrier 41, as controlled by the rear cam slot 73, results in the driving lug 44 entering into one of the openings 29 associated with the reel flange 26. Thus, as the carrier 41 is forwardly advanced, as guided by the cam roller 62 moving along the center cam slot 72, the drive unit 31 hence initiates rotation of the respective reel (which rotation is counterclockwise in FIGS. 1 and 2) so as to assist in unwinding of the tubing 12. Simultaneous with this initiation of rotation of the reel, the tube drive unit 13 is also engaging and forwardly advancing the tubing 12 into the apparatus 11.

As the power cylinder 32 continues to thrust the carrier 41 forwardly, the cam roller 62 moves into and downwardly along the front cam slot 74, whereupon the driving lug 44 is hence removed from the opening 29 so that the reel is no longer driven by the drive unit 31. However, since rotation of the reel 19 has now been initiated, the drive unit 13 associated with the apparatus 11 can now continue to drivingly engage and forwardly advance the tubing 12 into the apparatus 11, and hence continue the rotation of the reel 19 so as to effect unwrapping of the tubing until the desired length of tubing has been advanced into the apparatus. The reel 19 will continue to rotate freely during this continued advance of the tubing since the reel is supported by the antifriction bearings 27.

As the tubing 12 reaches a selected location within the apparatus 11, an appropriate stop switch on the apparatus 11 is activated, which in turn energizes the friction brake unit 81 so that cylinder 82 is energized to cause the respective brake shoe 84 to extend outwardly and engage the end surface 86 of the respective reel 19 so as to stop the rotation thereof.

The tubing as advanced into the apparatus 11 is then suitably clamped or held adjacent the free end thereof, and the tubing is then cut so as to sever a selected length thereof from the remaining tubing as attached to and wound around the reel. During this cutting of the tubing, the tubing is clampingly held adjacent the free end thereof, and the drive unit 13 is reversely energized so as to impose a rearward tension on the tubing to facilitate the cutting operation. However, this reverse energization of the drive unit 13 causes a slight backward movement of the tubing 12 toward the reel after the cutting operation has been completed, which backward movement of the tubing is terminated by deenergizing the drive unit 13 after all of the tubes have been cut. However, this limited backward movement of the tubing results in the formation of slack loops where the tubing extends between the individual reels and the input to the apparatus 11. At this point in time, the drive unit 31 is reversely energized so as to retract the reciprocal drive 33 back to its original position. Hence, the cam follower 62 moves up the front cam slot 74, whereupon the driving lug 44 again engages one of the openings 29 such that continued rearward movement of carrier 41 as the follower 62 moves rearwardly along the center cam slot 72 results in reverse rotation (clockwise in FIG. 2) of the reel so that a limited amount of tubing is hence wound onto the reel so as to eliminate the aforementioned slack loop. The cam follower then moves into the rear cam slot 73 so that driving lug 44 is again disengaged from the opening 29 to prevent further reverse rotation of the respective reel. The drive unit 31 is hence positioned so as to permit initiation of a new operational cycle. During this retraction of the reciprocal drive, the friction brake unit 81 is released just long enough to permit the desired reverse rotation of the reel.

During the initial movement of the reciprocal drive, on both the advancing and retracting strokes, it is unlikely that one of the openings 29 will be precisely aligned with the driving lug 44. Hence, as the driving lug moves inwardly towards the reel and hence engages the rim plate 28, the lug 44 will be depressed against the urging of the spring 53, and simultaneously therewith the carrier 41 will continue to move forwardly (or rearwardly) relative to the reel so that the rounded nose 46 of lug 44 will hence slide along the rim plate 28 until the lug 44 registers with the next adjacent opening 29, whereupon the spring 53 will then automatically urge the drive lug 44 outwardly so that it enters into the opening 29 to thereby create a positive driving engagement with the reel.

The presence of the single horizontal pivot pin 42 for connecting the carrier 41 to the piston rod hence permits relative pivoting therebetween. At the same time, the carrier 41 is slidably and pivotally supported on the cam plate 67 by means of the single cam follower 62 which hence permits the carrier 41 to pivot with respect to the cam plate. These parallel horizontal pivots 42 and 62, coupled with the wear plates 58 and 59, hence insure that the carrier 41 will properly move upwardly into engagement with the reel flange 26 so as to permit the driving lug 44 to engage one of the openings 29 while the carrier moves along the center cam slot 72. For example, if proper alignment is not initially achieved, then appropriate pivoting of the carrier 41 about the roller 62 will initially result in one of the wear plates 58 and 59 reacting against the rim plate 28, whereupon the imposition of the driving force on the carrier 41 by the piston rod 37 will hence cause appropriate pivoting of the carrier 41 about the cam follower 62 until the other wear plate 57 or 58 effectively moves into engagement with the reel rim 28.

In the preferred embodiment, a plurality of reels 19 are simultaneously and synchronously activated, and for this purpose all of the power cylinders 32 are preferably associated with a common pressure system and source so as to permit simultaneous activation thereof by means of conventional fluid controls. Fluid circuitry and controls for this purpose are well known. Similarly, the pressure cylinders for the friction brake units are also preferably commonly controlled by a single pressure circuit, the design and details of which are also conventional and well understood by those familiar with such circuitry. It will be apparent, however, that the individual drive units and friction brake units could also be individually controlled, if desired, depending upon the selected or desired mode of operation.

Although a particular preferred embodiment of the invention has been disclosed detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a coil stand having a frame, shaft means mounted on said frame, and reel means supported on said shaft means and being rotatable about the axis thereof, said reel means including a central core and pair of end flanges which project radially outwardly from said core adjacent the opposite ends thereof, whereby an elongated flexible element can be coiled about and supported on said reel means, the improvement comprising a reciprocal drive structure which is cyclically movable back-and-forth along a selected path, said path being free of loops, guide means for movably guidably supporting said reciprocal drive structure for reciprocal movement along said path, and power means connected to said drive structure for effecting the reciprocal movement thereof along said path, said path having a center portion extending between a pair of spaced end portions, and said drive structure having a driving element which is engageable with said reel means for drivingly rotating said reel means as said drive structure moves through said center path portion from said one end portion toward said other end portion, said drive structure being drivingly engageable with said reel means both when the drive structure moves forwardly through the center path portion for effecting unwinding rotation of said reel means and when the drive structure moves rearwardly through the center path portion for effecting opposite rotation of said reel means, said driving element being disengaged from said reel means when said drive structure is in either of said end portions of said path.

2. In a coil stand having a frame, shaft means mounted on said frame, and reel means supported on said shaft means and being rotatable about the axis thereof, said reel means including a central core and a pair of end flanges which project radially outwardly from said core adjacent the opposite ends thereof, whereby an elongated flexible element can be coiled about and supported on said reel means, the improvement comprising intermittently actuated drive means for initially engaging said reel means to initiate rotation thereof in one selected rotational direction and then automatically disengaging said reel means after rotation thereof through a selected angular extent to permit continued free rotation of said reel means in said one direction, said drive means comprising a reciprocal drive structure which is cyclically movable back-and-forth along a selected path, guide means for movably guidably supporting said reciprocal drive structure for reciprocal movement along said path, and power means connected to said drive structure for effecting the reciprocal movement thereof along said path, said path having a center portion extending between a pair of spaced end portions, and said drive structure having a driving element which is engageable with said reel means for drivingly rotating said reel means as said drive structure moves through said center path portion from said one end portion toward said other end portion, said driving element being disengaged from said reel means when said drive structure is in either of said end portions of said path, and said drive structure engages and drivingly rotates said reel means through only a small angular extent which is less than one-quarter revolution of said reel means.

3. A coil stand according to claim 2, wherein said path effectively defines a single centerline as it extends longitudinally from one end portion to the other end portion thereof, said path being free of loops, said drive structure being guidably moved along said path during both the forward and rearward strokes thereof.

4. A coil stand according to claim 3, wherein said path has the center portion thereof generated on a radius effectively centered about the axis of said shaft means, the end portions of said path extending circumferentially away from and being sloped radially outwardly relative to the center portion.

5. In a coil stand having a frame, shaft means mounted on said frame, and reel means supported on said shaft means and being rotatable about the axis thereof, said reel means including a central core and a pair of end flanges which project radially outwardly from said core adjacent the opposite ends thereof, whereby an elongated flexible element can be coiled about and supported on said reel means, the improvement comprising intermittently actuated drive means for initially engaging said reel means to initiate rotation thereof in one selected rotational direction and then automatically disengaging said reel means after rotation thereof through a selected angular extent to permit continued free rotation of said reel means in said one direction, said drive means comprising a reciprocal drive structure which is cyclically movable back-and-forth along a selected path, guide means for movably guidably supporting said reciprocal drive structure for reciprocal movement along said path, and power means connected to said drive structure for effecting the reciprocal movement thereof along said path, said path having a center portion extending between a pair of spaced end portions, and said drive structure having a driving element which is engageable with said reel means for drivingly rotating said reel means as said drive structure moves through said center path portion from said one end portion toward said other end portion, said driving element being disengaged from said reel means when said drive structure is in either of said end portions of said path, said path effectively defining a single centerline as it extends longitudinally from one end portion to the other end portion thereof, said path being free of loops, said drive structure being guidably moved along said path during both the forward and rearward strokes thereof; and said reel means has recess means formed on and circumferentially spaced around one of said flanges at substantially uniformly spaced intervals, said driving element projecting into one of said recesses when said drive structure is located in said center path portion so that displacement of said drive structure along said center path portion effects driving rotation of said reel means.

6. A coil stand according to claim 5, wherein said drive structure includes a carrier which is slidably and guidably supported along said path, said carrier having a pair of end portions which project outwardly and define wear surfaces which are adapted to bearingly engage against said one flange at circumferentially spaced locations thereon when said driving element is engaged within one of said recesses, said driving element being positioned at a location disposed between said pair of bearing surfaces.

7. A coil stand according to claim 6, wherein said driving element is movably supported on said carrier and spring-urged outwardly therefrom so as to project into one of said recesses, said driving element being movable inwardly relative to said carrier against the urging of said spring when said driving element does not align with one of said recesses so as to permit relative movement therebetween until said driving element is aligned with and spring-urged outwardly into engagement with one of said recesses.

8. A coil stand according to claim 6, wherein said guide means includes an elongated cam groove formed therein and defining said path, said carrier mounting thereon a single cam follower which is movably and guidably confined within said cam groove for movement therealong, said cam follower defining a first axis which permits relative pivotal movement between said guide means and said carrier, said power means including a fluid pressure cylinder having a piston rod which is pivotally connected to said carrier at a location which defines a second axis which is parallel to but spaced from said first axis, and said carrier defining thereon a pair of bearing surfaces which are movable into engagement with or close proximity to said reel means when said drive structure is drivingly engaged with said reel means for initially positioning and then maintaining the desired positional relationship between said reel means and said carrier.

9. In combination, a forming apparatus for cutting and forming tubing, said forming apparatus having a tubing-advancing drive unit associated therewith for engaging the tubing and intermittently feeding said tubing into the apparatus, and a coil stand positioned adjacent the apparatus for permitting elongate flexible tubing to be intermittently supplied to said forming apparatus, said coil stand including a frame mounting thereon reel-supporting shaft means, and reel means supported on said shaft means and being rotatable about the axis thereof, said reel means including a pair of end flanges which confine a coil of said tubing therebetween, said tubing as unwound from said stand being led therefrom into said forming apparatus wherein it is engaged by the drive unit thereof, comprising drive means engageable with one of said end flanges of said reel means to initiate rotation thereof in an unwinding direction to permit feeding of tubing from said reel means to said apparatus, said drive means being automatically disengaged from said reel means after a selected interval to permit continued free rotation of said reel means in said unwinding direction, said drive means being guided for movement along a guide path so that said drive structure is drivingly engaged with said reel means as said drive structure is unidirectionally moved forwardly along an elongated center portion of said path, said drive structure being drivingly disengaged from said reel means when located at either end portion of said path, said drive structure including a carrier having a spring-urged driving element movably supported thereon and projecting outwardly therefrom, said one end flange having an annular surface provided with a plurality of recesses formed therein at uniform angularly spaced intervals therearound, said driving element being engageable with said recesses.

10. The combination according to claim 9, wherein said path is free of loops, and said drive structure being drivingly engageable with said reel means both when the drive structure moves forwardly through the center path portion for effecting unwinding rotation of said reel means and when the drive structure moves rearwardly through the center path portion for effecting opposite rotation of said reel means to at least partially remove the slack in that portion of the tubing which extends between said reel means and said apparatus.

11. The combination according to claim 10, wherein said path is nonlinear, the elongated center portion of said path being relatively straight and substantially uniformly spaced relative to the circumference of one of said flanges, the end portions of said path each extending circumferentially and sloping radially outwardly relative to said center portion and relative to said flange.

12. The combination according to claim 10, including selectively energizeable brake means mounted on said stand and engageable with said reel means to selectively stop or stationarily hold same.

13. In combination, a forming apparatus for cutting and forming tubing, said forming apparatus having a tubing-advancing drive unit associated therewith for engaging the tubing and intermittently feeding said tubing into the apparatus, and a coil stand positioned adjacent the apparatus for permitting elongate flexible tubing to be intermittently supplied to said forming apparatus, said coil stand including a frame mounting thereon reel-supporting shaft means, and reel means supported on said shaft means and being rotatable about the axis thereof, said reel means including a pair of end flanges which confine a coil of said tubing therebetween, said tubing as unwound from said stand being led therefrom into said forming apparatus wherein it is engaged by the drive unit thereof, comprising drive means engageable with said reel means to initiate rotation thereof in an unwinding direction to permit feeding of tubing from said reel means to said apparatus, said drive means being automatically disengaged from said reel means after a selected interval to permit continued free rotation of said reel means in said unwinding direction, said drive means including a drive structure which is guided for movement along a guide path which is free of loops so that said drive structure is drivingly engaged with said reel means as said drive structure is unidirectionally moved forwardly along an elongated center portion of said path, said drive structure being drivingly disengaged from said reel means when located at either end portion of said path, said drive structure being drivingly engageable with said reel means both when the drive structure moves forwardly through the center path portion for effecting unwinding rotation of said reel means and when the drive structure moves rearwardly through the center path portion for effecting opposite rotation of said reel means to at least partially remove the slack in that portion of the tubing which extends between said reel means and said apparatus, and said drive means further includes a reciprocal fluid pressure cylinder connected to said drive structure for effecting reciprocal back-and-forth movement thereof along said path.

* * * * *